US007804457B2

(12) United States Patent
Oshiyama et al.

(10) Patent No.: US 7,804,457 B2
(45) Date of Patent: Sep. 28, 2010

(54) MULTI-BAND ANTENNA WITH INDUCTOR AND/OR CAPACITOR

(75) Inventors: Tadashi Oshiyama, Gunma (JP); Hirotoshi Mizuno, Gunma (JP); Yusuke Suzuki, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 380 days.

(21) Appl. No.: 11/645,012

(22) Filed: Dec. 26, 2006

(65) Prior Publication Data

US 2007/0146221 A1 Jun. 28, 2007

(30) Foreign Application Priority Data

Dec. 27, 2005 (JP) ..... P2005-375101

(51) Int. Cl.
*H01Q 9/00* (2006.01)
*H01Q 9/04* (2006.01)

(52) U.S. Cl. ..... 343/749; 343/825

(58) Field of Classification Search ..... 343/895, 343/700 MS, 702, 752, 741, 744, 745, 747–750, 343/803, 825, 828, 829
See application file for complete search history.

(56) References Cited

U.S. PATENT DOCUMENTS 6,515,625 B1 * 2/2003 Johnson ..... 343/700 MS
6,903,688 B2 * 6/2005 Edvardsson ..... 343/700 MS
7,336,239 B2 2/2008 Takei
7,420,511 B2 * 9/2008 Oshiyama et al. ..... 343/700 MS
2003/0020661 A1 * 1/2003 Sato ..... 343/702
2006/0017635 A1 * 1/2006 Zheng ..... 343/748

FOREIGN PATENT DOCUMENTS

KR 10-2005-0050098 5/2005
WO WO 2004/047223 A1 6/2004

* cited by examiner

*Primary Examiner*—Hoang V Nguyen
*Assistant Examiner*—Robert Karacsony
(74) *Attorney, Agent, or Firm*—Morgan, Lewis & Bockius LLP

(57) ABSTRACT

A multi-band antenna is adapted to operate in a first frequency band and a second frequency band which is lower than the first frequency band. In the multi-band antenna, an antenna element has an electrical length of ¾ wavelength of the first frequency band. The antenna element has a first end adapted to be electrically connected to a power feeding point, and a second end. An inductor is electrically connected between the second end of the antenna element and a ground in a serial manner. The inductor has such an inductance that an electrical length of the antenna element and the inductor corresponds to ½ wavelength of the second frequency band.

8 Claims, 10 Drawing Sheets

MULTI-BAND ANTENNA WITH INDUCTOR AND/OR CAPACITOR

BACKGROUND

The present invention relates to a multi-band antenna employing a single antenna element adapted to operate in multiple frequency bands.

Recent mobile communication has developed rapidly. Among others, mobile phones have proliferated outstandingly and improvements have been made to reduce their size and weight significantly. According to mobile phone standards, two particular frequency bands are used respectively in different regions: in Japan, a 800 MHz band and a 1.5 GHz band for Personal Digital Cellular (PDC); in Europe, a 900 MHz band and a 1.9 GHz band for Global System for Mobile Communications (GSM); and in North America, a 800 MHz band for Advanced Mobile Phone System (AMPS) and a 1.9 GHz band for Personal Communications System (PCS). Moreover, communication systems such as Global Positioning System (GPS) using 1.5 GHz, Bluetooth using a 2.4 GHz band, and International Mobile Telecommunications (IMT) 2000 using a 2 GHz band are put in practical use for mobile communication and data transmission. If a single antenna is capable of operating in the above-mentioned multiple frequency bands, it would be ideal for the purpose of reducing antenna size and weight.

International Publication No. WO2004/047223A1 discloses an antenna employing a single antenna element adapted to operate in multiple frequency bands. The antenna is configured such that an antenna element has a power-side end which is electrically connected to a power feeding point and intermediate points and a ground-side end which are electrically connected to a ground conductor via switches. By closing one of the switches and opening the remaining switches, it is possible to select the electric length of the antenna element up to the electric connection to the ground conductor from the power feeding point via the closed switch. Further, by selectively controlling the switches, the electric length of the antenna element can be selected, and thus the single antenna element can serve as a multi-band antenna.

Further, instead of the switches, filters may be inserted between the intermediate points and the ground-side end of the antenna element and the ground conductor. The filters are configured so as to allow the passage of only a frequency band where the electric length of the antenna element from the power feeding point to a connection position of the filters corresponds to ½ wavelength of the frequency band. In this case, the filters can serve as the same when the switch is closed only in a passage frequency band, and thus it is possible to allow the single antenna element to serve as a multi-band antenna.

Furthermore, instead of the switches, serial resonant circuits may be inserted between the intermediate points and the ground-side end of the antenna element and the ground conductor. The serial resonant circuits are configured so as to serially resonate in a frequency band where the electric length of the antenna element from the power feeding point to a connection position of the serial resonant circuits corresponds to ½ wavelength of the frequency band. In this case, the serial resonant circuits can serve as the same when the switch is closed only in a passage frequency band, and thus it is possible to allow the single antenna element to serve as a multi-band antenna at the same time.

Furthermore, instead of the switches, a parallel resonant circuit may be inserted between one of the intermediate points and the ground-side end of the antenna element. The parallel resonant circuits are configured so as to resonate in a frequency band where the electric length of the antenna element from the power feeding point to a connection position of the parallel resonant circuits corresponds to ½ wavelength of the frequency band. In this case, the parallel resonant circuits serve as if the switches are closed in a conduction state in a frequency band where electric length of the antenna element with respect to the connection position corresponds to ½ wavelength of the frequency band and prevent the passage of the frequency band where the electric length of the antenna element with respect to the other connection position corresponds to ½ wavelength of the frequency band to serve as if the switches are opened. As a result, it is possible to allow the single antenna element to serve as an antenna for two frequency bands at the same time.

However, with the above configurations, the switches, the filters, the serial resonant circuits, and the parallel resonant circuits should be inserted between the intermediate points and the ground-side end of the antenna element and the ground conductor, and thus spaces for providing them are required, which makes it difficult to reduce the size of the circuit. Further, even though mechanical switches or semiconductor switches are used, the transmission signal is attenuated due to the insertion loss. Further, it is difficult to obtain a sufficient isolation when using the semiconductor switch or filter.

SUMMARY

It is therefore an advantageous aspect of the invention to provide a multi-band antenna which allows a single antenna element to operate in a plurality of frequency bands even though only the ground-side end of the antenna element is electrically connected to the ground conductor via an electric circuit, that is, without electrically connecting the intermediate point of the antenna element to the ground conductor via the switches.

According to one aspect of the invention, there is provided a multi-band antenna, adapted to operate in a first frequency band and a second frequency band which is lower than the first frequency band, the multi-band antenna comprising:

an antenna element, having an electrical length of ¾ wavelength of the first frequency band, the antenna element comprising:

a first end, adapted to be electrically connected to a power feeding point; and a second end; and an inductor, electrically connected between the second end of the antenna element and a ground in a serial manner, wherein:

the inductor has such an inductance that an electrical length of the antenna element and the inductor corresponds to ½ wavelength of the second frequency band.

With this configuration, since the second end of the antenna element is grounded via the inductor, the antenna element can serve as a folded dipole antenna for the second frequency band. Further, since the electric length of the antenna element is set to ¾ wavelength of the first frequency band where the inductor serves as a choke coil. The second end of the antenna element is not grounded but is made open with respect to the first frequency band, and thus the antenna element serves as a ¾ wave pole antenna. Therefore, the single antenna element can operate as an antenna for both of the frequency bands, As a result, it is not necessary to provide a circuit for grounding an intermediate point of the antenna element as in the related art, thereby reducing the space for grounding.

According to one aspect of the invention, there is provided a multi-band antenna, adapted to operate in a first frequency band, a second frequency band which is lower than the first frequency band, and a third frequency band which is lower than the second frequency band, the multiband antenna comprising:

an antenna element, having an electrical length of ¾ wavelength of the second frequency band, the antenna element comprising:

a first end, adapted to be electrically connected to a power feeding point; and a second end; and a parallel circuit, electrically connected between the second end of the antenna element and a ground in a serial manner, the parallel circuit including an inductor and a capacitor which are electrically connected in a parallel manner, wherein:

the capacitor has such a capacitance that an electrical length of the antenna element and the capacitor corresponds to ½ wavelength of the first frequency band; and the inductor has such an inductance that an electrical length of the antenna element and the inductor corresponds to ½ wavelength of the third frequency band.

With this configuration, the second end of the antenna element is grounded via the parallel circuit, the parallel resonant frequency of the parallel circuit is set to the second frequency band, and the electric length of the antenna element is set to ¾ wavelength of the second frequency band. Therefore, the second end of the antenna element is not grounded by the parallel circuit but is made open with respect to the second frequency band, and thus the antenna element serves as a ¾ wave pole antenna. Further, the antenna element serves as a folded dipole antenna for the third frequency band, and further serves as a folded dipole antenna for the first frequency band. Therefore, the single antenna element can operate as an antenna for all three of the frequency bands. As a result, it is not necessary to provide a circuit for grounding an intermediate point of the antenna element as in the related art, thereby reducing the space for grounding.

According to one aspect of the invention, there is provided a multi-band antenna, adapted to operate in a first frequency band and a second frequency band which is lower than the first frequency band, the multi-band antenna comprising:

an antenna element, having an electrical length of ½ wavelength of the first frequency band and ¼ wavelength of the second frequency band, the antenna element comprising:

a first end, adapted to be electrically connected to a power feeding point; and a second end; and a first inductor and a parallel circuit, electrically connected between the second end of the antenna element and a ground in a serial manner, the parallel circuit including a second inductor and a capacitor which are electrically connected in a parallel manner, wherein:

the parallel circuit is so configured as to parallel-resonate with the first frequency band; and the first inductor and the capacitor are so configured as to serial-resonate with the second frequency band.

With this configuration, the second end of the antenna element is grounded via the first inductor and the parallel circuit in a serial manner. Further, the parallel resonant frequency of the parallel circuit is set to the second frequency band, and the electric length of the antenna element is set to ¼ wavelength of the second frequency band. Accordingly, the second end of the antenna element is not grounded by the parallel circuit but is made open with respect to the second frequency band, and thus the antenna element serves as a ¼ wave pole antenna. Further, since the serial resonant frequency of the serial circuit of the capacitor and the first inductor is set to the first frequency band, and the electric length of the antenna element is set to ½ wavelength of the first frequency band, the second end of the antenna element is not grounded by the serial circuit but is made open with respect to the first frequency band, and thus the antenna element serves as a ½ wave pole antenna. Therefore, the single antenna element can operate as an antenna for both of the frequency bands. As a result, it is not necessary to provide a circuit for grounding an intermediate point as in the related art, thereby reducing the space for grounding.

According to one aspect of the invention, there is provided a multi-band antenna, adapted to operate in a first frequency band and a second frequency band which is lower than the first frequency band, the multi-band antenna comprising:

an antenna element, having an electrical length of ¾ wavelength of the first frequency band and ½ wavelength of the second frequency band, the antenna element comprising:

a first end, adapted to be electrically connected to a power feeding point; and a second end; and a first capacitor and a parallel circuit, electrically connected between the second end of the antenna element and a ground in a serial manner, the parallel circuit including an inductor and a second capacitor which are electrically connected in a parallel manner, wherein:

the parallel circuit is so configured as to parallel-resonate with the first frequency band; and the inductor and the second capacitor are so configured as to serial-resonate with the second frequency band.

With this configuration, the second end of the antenna element is grounded via the first capacitor and the parallel circuit in a serial manner, the parallel resonant frequency of the parallel circuit is set to the first frequency band, and the electric length of the antenna element is set to ¾ wavelength of the first frequency band. Accordingly, the second end of the antenna element is not grounded by the parallel circuit but is made open with respect the first frequency band, and thus the antenna element serves as a ¾ wave folded pole antenna. Further, since the serial resonant frequency of the serial circuit of the inductor and the first capacitor is set to the second frequency band, and the electric length of the antenna element is set to ½ wavelength of the second frequency band, the second end of the antenna element is not grounded by the serial circuit but is made open with respect to the low frequency band, and thus the antenna element serves as a ½ wave folded pole antenna. Therefore, the single antenna element can operate as an antenna for both of the frequency bands. As a result, it is not necessary to provide a circuit for grounding an intermediate point as in the related art, thereby reducing the space for grounding.

In the above multi-band antennas, the first end of the antenna element may be provided with a matching circuit.

With this configuration, since the matching circuit is inserted between the power feeding point and the first end of the antenna element, it is possible to provide an impedance matching of the power feeding point and the antenna element, and to reduce the anti-resonant point.

DETAILED DESCRIPTION OF EXEMPLARY EMBODIMENTS

Exemplary embodiments will be described below in detail with reference to the accompanying drawings.

Figure 1:
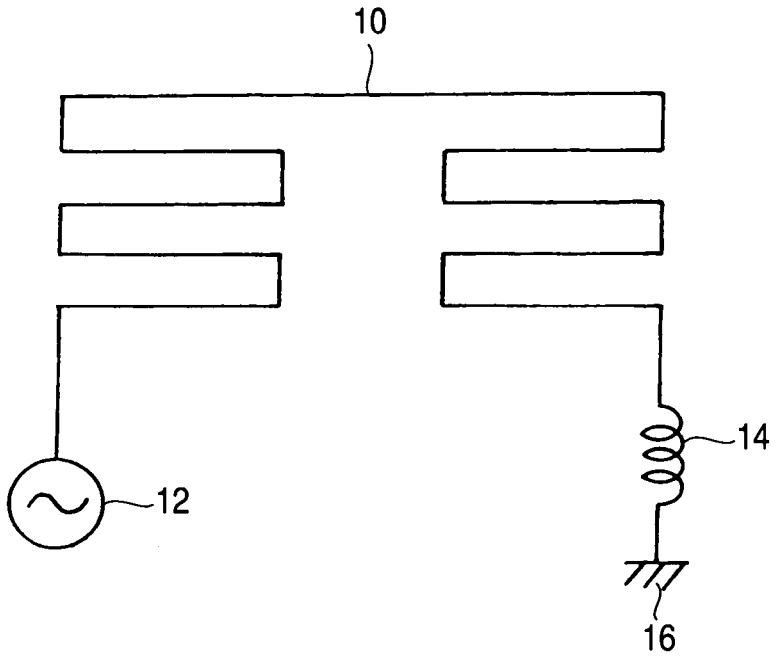
FIG. 1 is a circuit diagram illustrating a multiband antenna according to a first embodiment of the invention.

In a multi-band antenna according to a first embodiment of the invention, as shown in FIG. 1, a power-side end of an antenna element 10 is electrically connected to a power feeding point 12, and a ground-side end is electrically connected to a ground conductor 16 via an inductor 14 in a serial manner. An electric length of the antenna element 10 is set to ¾ wavelength of a high frequency band FH. Further, a value of the inductor 14 is set such that the electric length of a serial circuit of the antenna element 10 and the inductor 14 corresponds to ½ wavelength of a low frequency band FL. For example, the high frequency band FH is 1.5 GHz band for GPS, and the low frequency band FL is 800 MHz hand for CDMA. Therefore, the value of the inductor 14 is 33 nH.

In this embodiment, the antenna element 10 is bent in a meandering pattern in order to reduce the size of the antenna element 10. However, the antenna element 10 may be bent in a zigzag pattern. Further, the antenna element may be formed in a simple pattern such as a C-shape or a U-shape or double folded shape.

Figure 2:
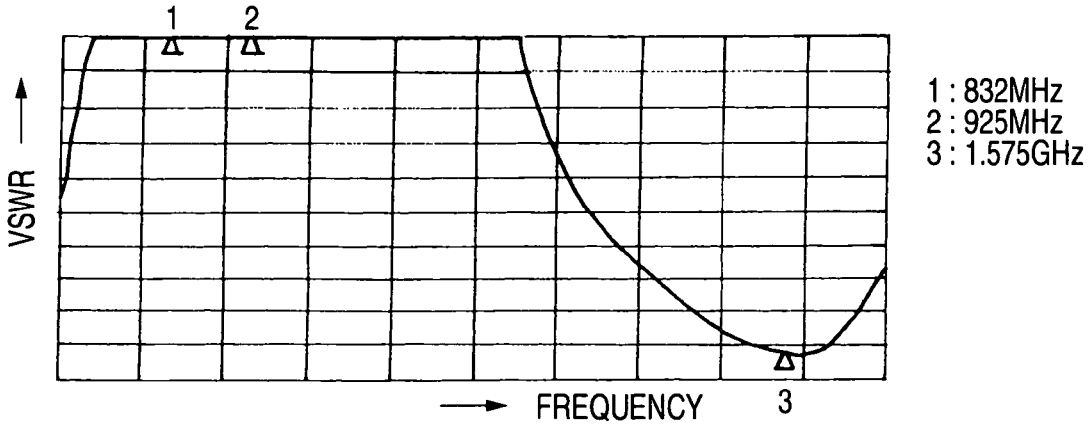
FIG. 2 is a VSWR characteristic graph when a ground-side end of an antenna element in the multi-band antenna of FIG. 1 is made open.
Figure 3:
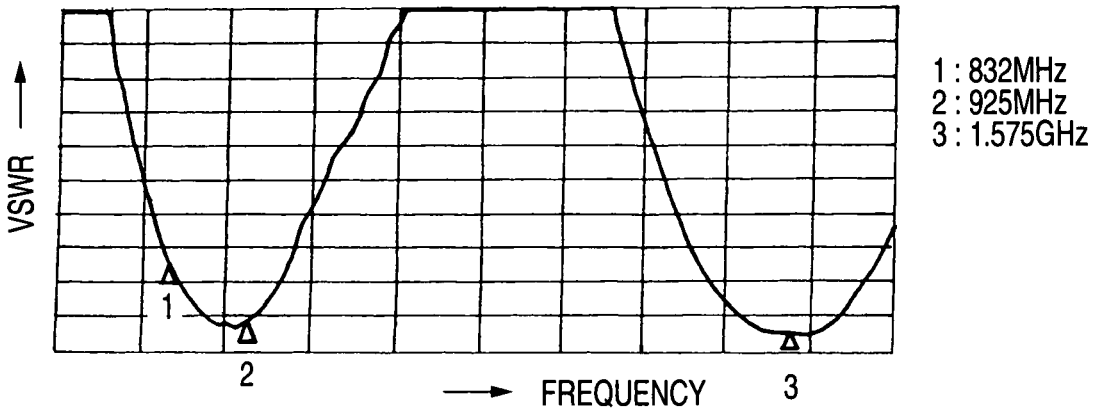
FIG. 3 is a VSWR characteristic graph of the multi-band antenna of FIG. 1.
Figure 4:
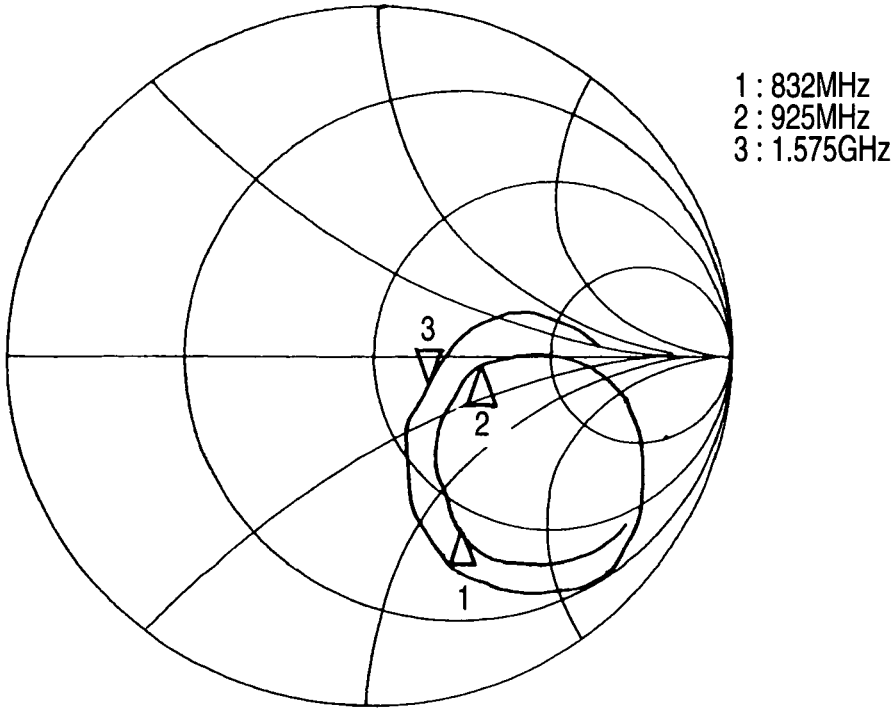
FIG. 4 is a Smith chart of the multi-band antenna of FIG. 1.
Figure 5:
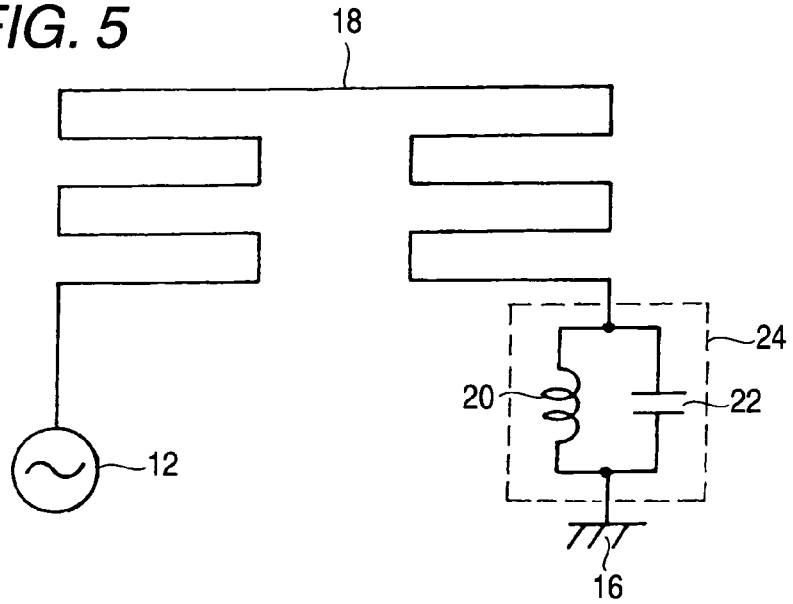
FIG. 5 is a circuit diagram illustrating a multi-band antenna according to a second embodiment of the invention.
Figure 6:
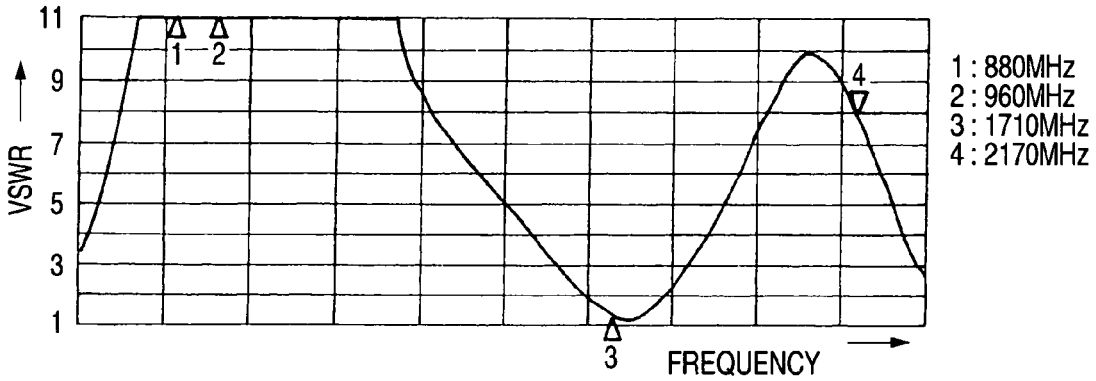
FIG. 6 is a VSWR characteristic graph when a ground-side end of an antenna element in the multi-band antenna of FIG. 5 is made open.

As mentioned the above, the electric length of the antenna element 10 is set to ¾ wavelength of the high frequency band FH. Therefore, when the ground-side end of the antenna element 10 is made open, the antenna element serves as a pole antenna for the high frequency band FH, but does not serve as an antenna for the low frequency band FL (see FIG. 2). On the other hand, when the ground-side end of the antenna element 10 is electrically connected to the ground conductor 16 via the inductor 14, the antenna element can satisfactorily serve as an antenna for both the high frequency band FH and the low frequency band FL (see FIGS. 3 and 4). In the high frequency band FH, the inductor 14 serves as a choke coil, the passage of the high frequency band FH is prevented and the ground-side end is made open so that the antenna element serves as a pole antenna for the low frequency band FL, the inductor 14 serves as a loading coil and the low frequency band FL passes through the antenna element, and the antenna element serves as a folded dipole antenna.

Further, it is possible to arbitrarily select any of the high frequency band FH and the low frequency band FL without any specific restriction. However, when the high frequency band FH exceeds twice the low frequency band FL, experimentally, the required value of the inductor 14 becomes too large, the antenna characteristics becomes deteriorated. Further, it is preferable to provide an impedance matching by inserting a matching circuit in a serial manner between the power-side end of the antenna element 10 and the power feeding point 12.

Next, a second embodiment of the invention will be described with reference to FIGS. 5 to 8. Components similar to those in the first embodiment will be designated by the same reference numerals and repetitive explanations for those will be omitted.

In this embodiment, a ground-side end of an antenna element 18 is electrically connected to a ground conductor 16 via a parallel circuit 24 in a serial manner. In the parallel circuit 24, an inductor 20 and a capacitor 22 are connected parallel to each other. The electric length of the antenna element 18 is set to ¾ wavelength of the middle frequency band FM, and the parallel circuit 24 is configured so as to resonate in parallel in the middle frequency band FM. Further, the electric length of the serial circuit of the antenna element 18 and the inductor 20 is set to ½ wavelength of the low frequency band FL. Furthermore, the electric length of the serial circuit of the antenna element 18 and the capacitor 22 is set to ½ wavelength of the high frequency band FH. For example, the high frequency band is 2 GHz band for IMT-2000, and the middle frequency band FM is 1.8 GHz band for GSM, and the low frequency band is 900 MHz band for GSM. The value of the inductor 20 is 22 nH, and the value of the conductor 22 is 0.5 pF.

As mentioned the above, the electric length of the antenna element 18 is set to ¾ wavelength of the middle frequency band FM. Therefore, when the ground-side end of the antenna element 18 is made open, the antenna element serves as a pole antenna for the middle frequency band FM, but does not serve as an antenna for and the high frequency band FH and the low frequency band FL (see FIG. 6). On the other hand, when the ground-side end of the antenna element 18 is electrically connected to the ground conductor 16 via a parallel circuit 24 in a serial manner, the antenna element can satisfactorily serve as an antenna even in any of the high frequency band FH, the middle frequency band FM, and the low frequency band FL (see FIGS. 7 and 8). In the middle frequency band FM, the parallel circuit 24 serves as a parallel resonant circuit, the passage of the middle frequency band FM is prevented and the ground-side end is made open so that the antenna element serves as a pole antenna for the low frequency band FL, the inductor 22 serves as an extension coil and the low frequency band FL passes through the antenna element, and the antenna element serves as a folded dipole antenna for the high frequency band FH, the capacitor 22 serves as a short coil and the high frequency band FH passes through the antenna element, and the antenna element serves as a folded dipole antenna.

By setting the middle frequency band, there are some restrictions in the selection of the high frequency band FH and the low frequency band FL. However, by appropriately setting the values of the inductor 20 and the capacitor 22, it is possible to cause the antenna to operate for three different frequency bands.

Figure 9:
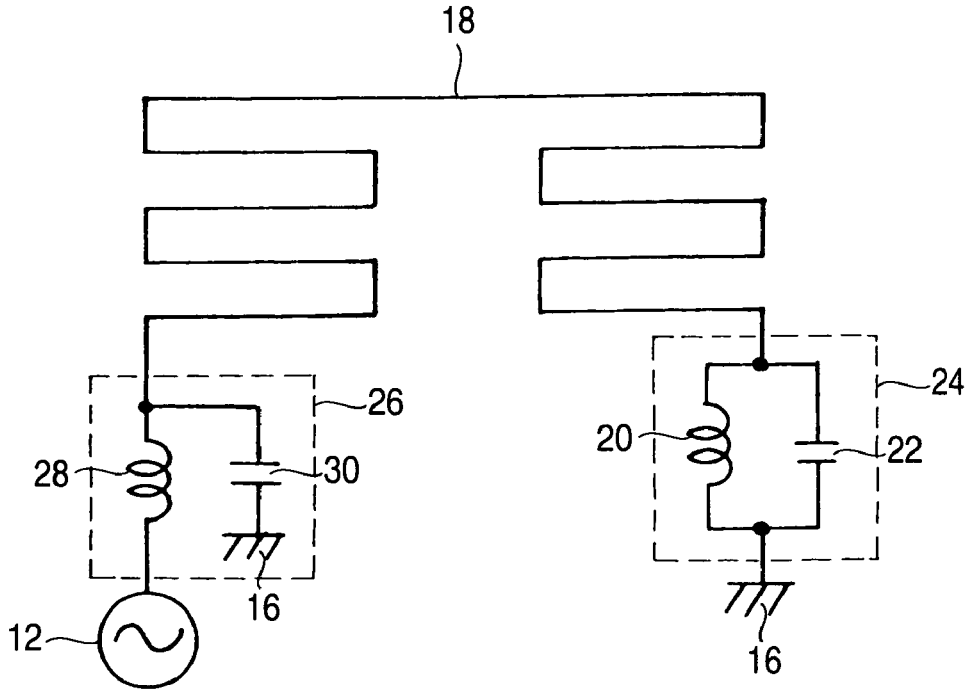
FIG. 9 is a circuit diagram illustrating a multi-band antenna according to a third embodiment of the invention.

Next, a third embodiment of the invention will be described with reference to FIGS. 9 to 11. Components similar to those in the above embodiments will be designated by the same reference numerals and repetitive explanations for those will be omitted.

In this embodiment, a power-side end of an antenna element 18 is electrically connected to a power feeding point 12 via a matching circuit 26 in a serial manner. For example, the matching circuit 26 is configured such that an inductor 28 is electrically connected in a serial manner between the power-side end of the antenna element 18 and the power feeding point 12, and a capacitor 30 is electrically connected in a serial manner between the power-side end of the antenna element 18 and a ground conductor 16. The electric length of a serial circuit of the antenna element 18 and the inductor 28 of the matching circuit 26 is set to set to ¾ wavelength of the middle frequency band FM. In the matching circuit 26, the value of the inductor 28 is 2.2 nH, and the value of the conductor 30 is 0.25 pF.

Figure 7:
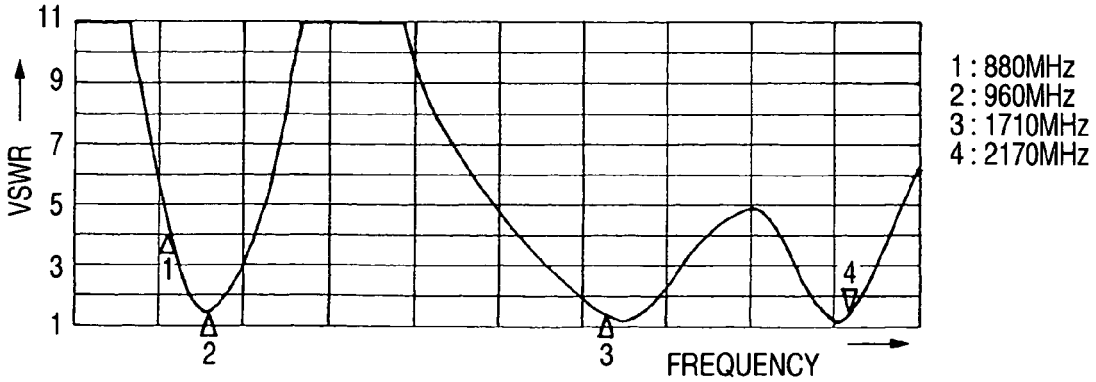
FIG. 7 is a VSWR characteristic graph of the multi-band antenna of FIG. 5.
Figure 8:
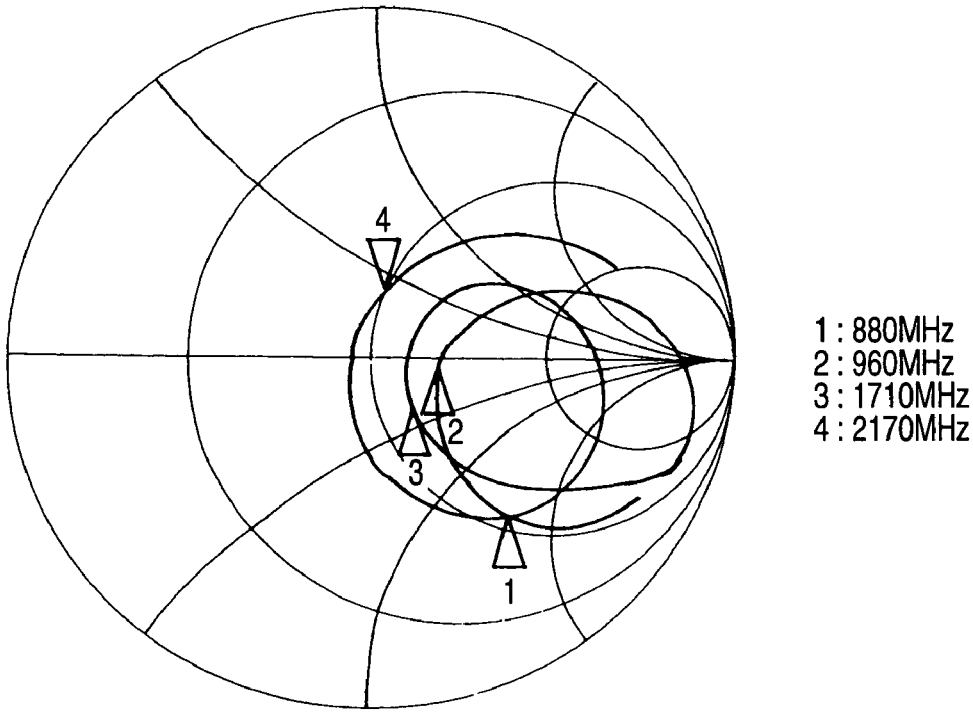
FIG. 8 is a Smith chart of the multi-band antenna of FIG. 5.
Figure 10:
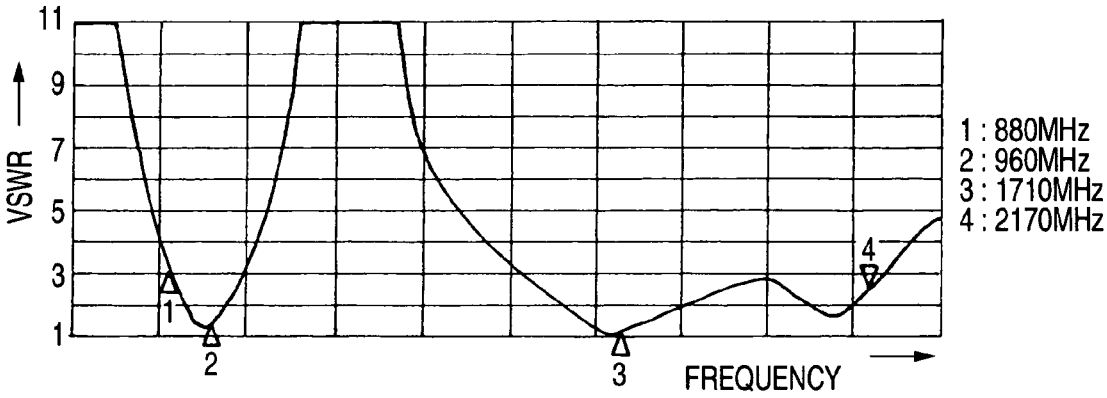
FIG. 10 is a VSWR characteristic graph of the multi-band antenna of FIG. 9.
Figure 11:
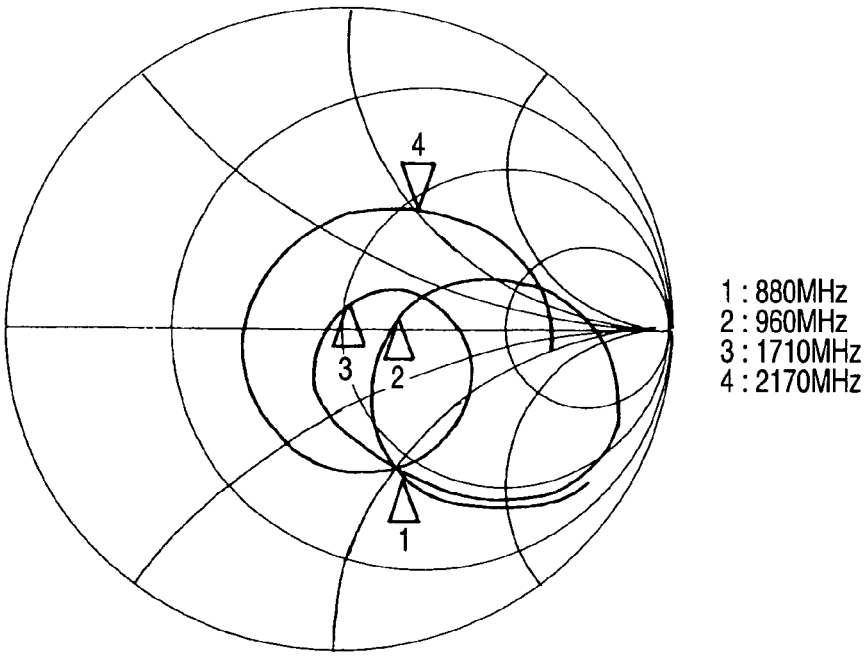
FIG. 11 is a Smith chart of the multi-band antenna of FIG. 9.
Figure 12:
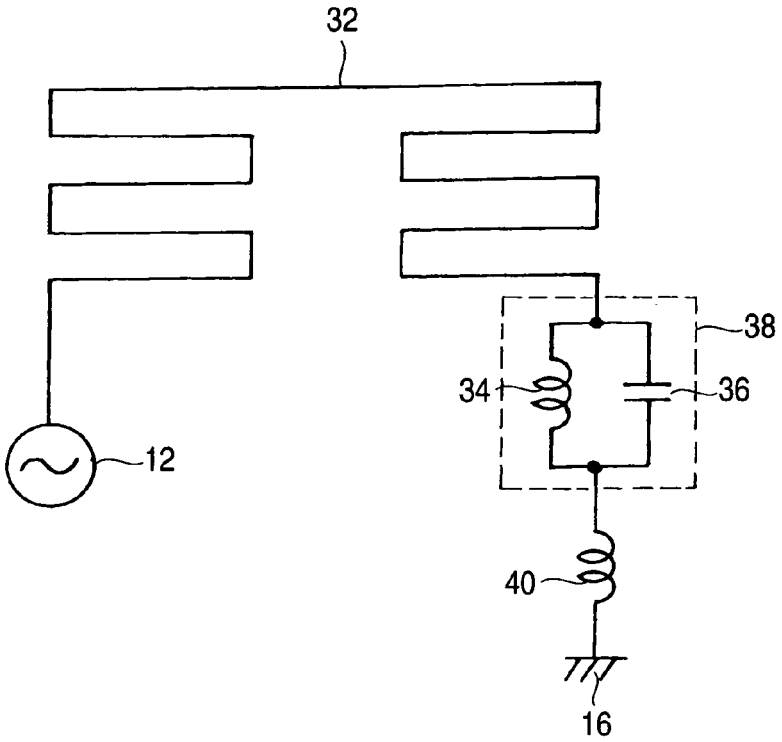
FIG. 12 is a circuit diagram illustrating a multi-band antenna according to a fourth embodiment of the invention.
Figure 13:
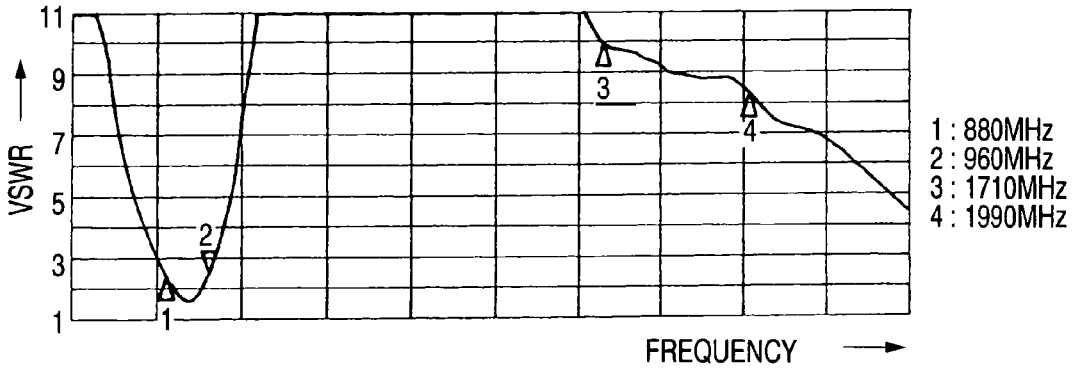
FIG. 13 is a VSWR characteristic graph when a ground-side end of an antenna element in the multi-band antenna of FIG. 12 is made open.
Figure 14:
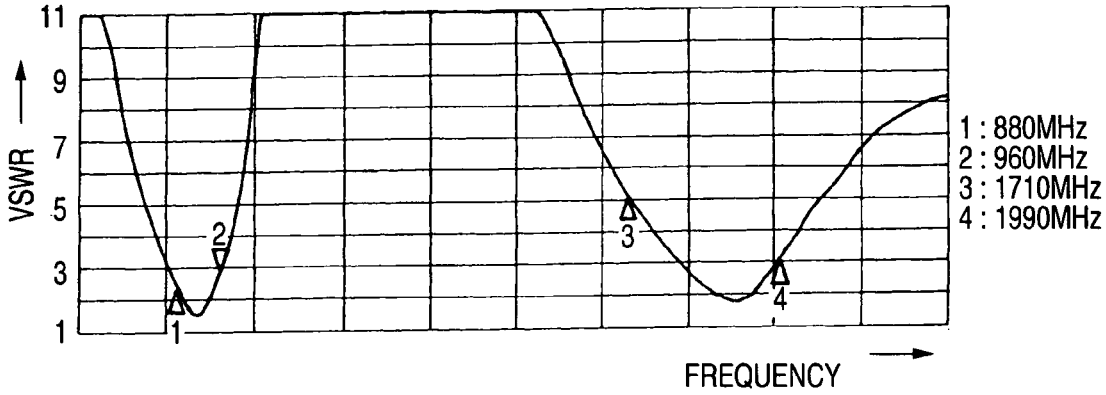
FIG. 14 is a VSWR characteristic graph of the multi-band antenna of FIG. 12.
Figure 15:
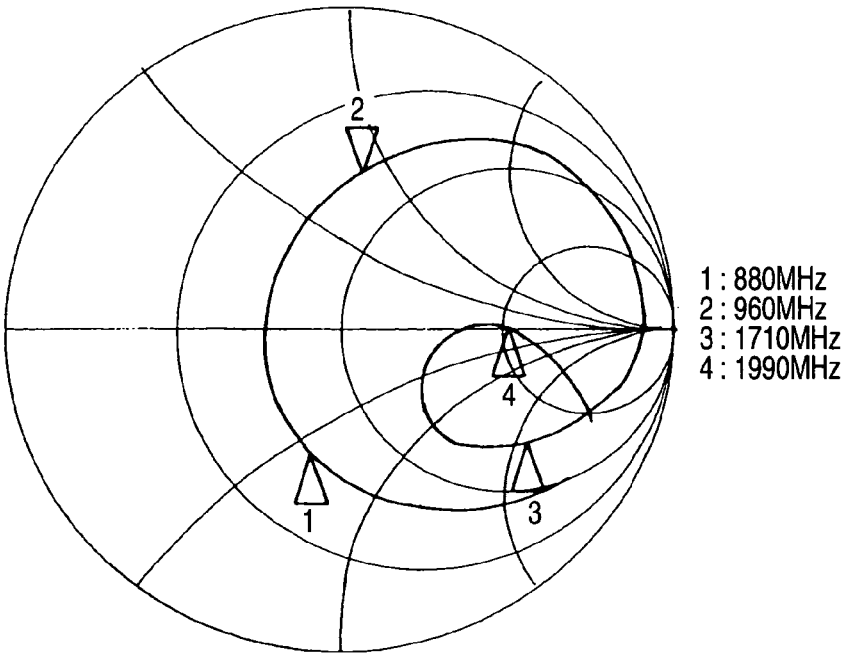
FIG. 15 is a Smith chart of the multi-band antenna of FIG. 12.
Figure 16:
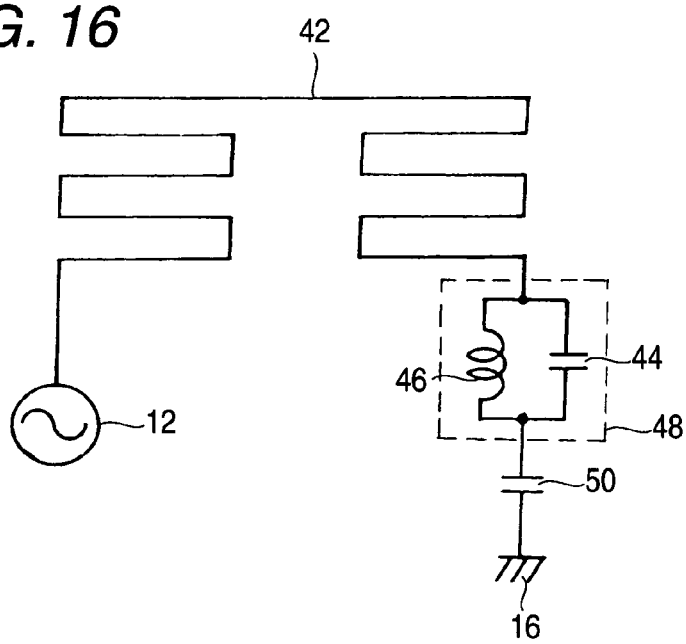
FIG. 16 is a circuit diagram illustrating a multi-band antenna according to a fifth embodiment of the invention.
Figure 17:
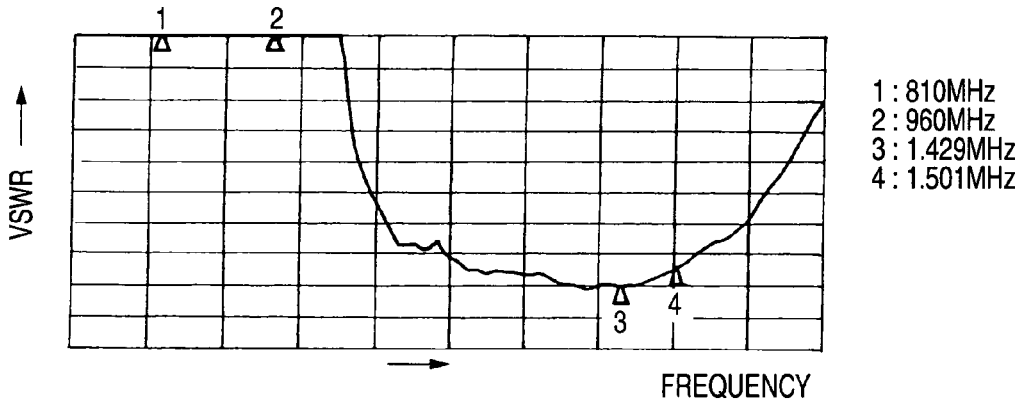
FIG. 17 is a VSWR characteristic graph when a ground-side end of an antenna element in the multi-band antenna of FIG. 16 is made open.
Figure 18:
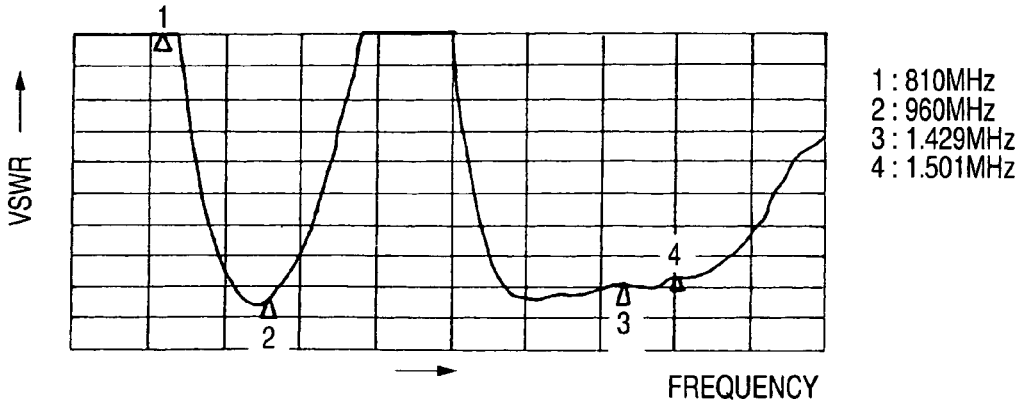
FIG. 18 is a VSWR characteristic graph of the multi-band antenna of FIG. 16.
Figure 19:
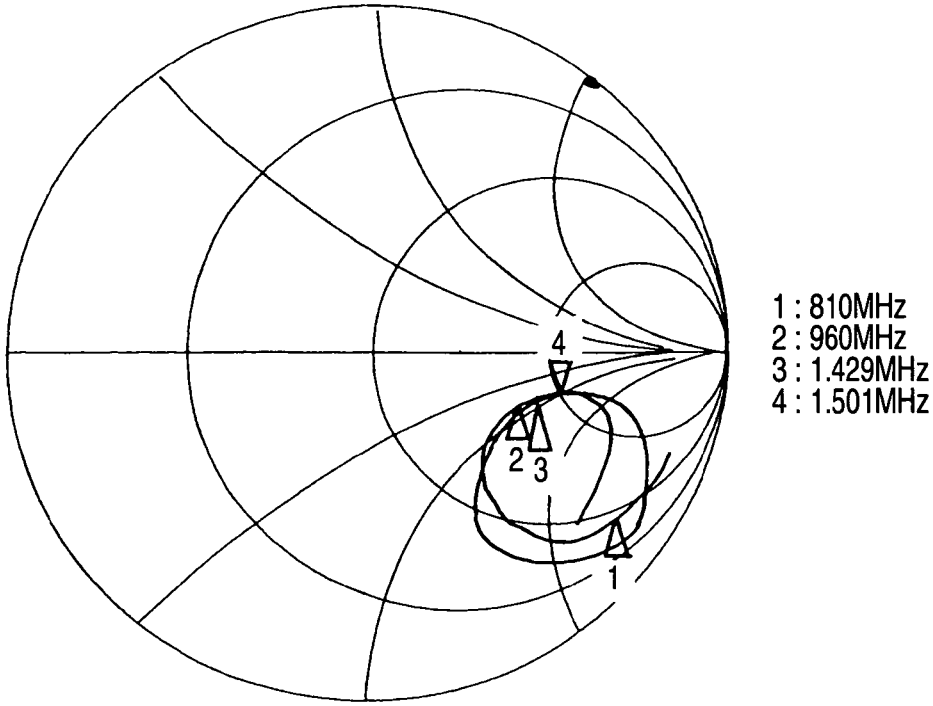
FIG. 19 is a Smith chart of the multi-band antenna of FIG. 16.

With the above configuration, as shown in FIGS. 10 and 11, it is possible to reduce the influence of an anti-resonant point caused between the middle frequency band FM and the high frequency band FH shown in FIG. 7 by providing the matching circuit 26. Further, it is possible to attain the impedance matching of the antenna element 18 and the power feeding point 12.

Next, a fourth embodiment of the invention will be described with reference to FIGS. 12 to 15. Components similar to those in the above embodiments will be designated by the same reference numerals and repetitive explanations for those will be omitted.

In this embodiment, a ground-side end of an antenna element 32 is electrically connected to a ground conductor 16 via a parallel circuit 38 in which a first inductor 34 and a capacitor 36 are connected in a parallel manner and a second inductor 40 in a serial manner. The electric length of the antenna element 32 is set to ½ wavelength of the high frequency band FH, and ¼ wavelength of the low frequency band FL. The parallel circuit 38 is configured so as to serve as a parallel resonant circuit in the low frequency band FL. The serial circuit of the capacitor 36 of the parallel circuit 38 and the second inductor 40 are configured so as to serve as a serial resonant circuit in the high frequency band FH. For example, the high frequency band is 1.8 GHz band for GSM, and the low frequency band is 900 MHz band for GSM. Further, the value of the first inductor 34 is 39 nH, the value of the conductor 36 is 0.5 pF, and the value of the second inductor 40 is 15 nH.

As mentioned the above, the electric length of the antenna element 32 is set to ¼ wavelength of the low frequency band FL. Therefore, when the ground-side end of the antenna element 18 is made open, the antenna element serves as a pole antenna for the low frequency band FL, but does not serve as an antenna for and the high frequency band FH (see FIG. 13). On the other hand, when the ground-side end of the antenna element 32 is electrically connected to the ground conductor 16 via the parallel circuit 38 and the second inductor 40 in a serial manner, the antenna element can satisfactorily serve as an antenna for both the high frequency band FH and the low frequency band FL (see FIGS. 14 and 15). In the low frequency band FL, the parallel circuit 38 serves as a parallel resonant circuit, the passage of the low frequency band FL is prevented and the ground-side end is made open so that the antenna element serves as a pole antenna for the high frequency band FH, the serial circuit of the capacitor 36 and the second inductor 40 serves as a serial resonant circuit, and the high frequency band FH passes through the antenna element to be electrically connected to the ground conductor 16, and thus the antenna element serves as a folded dipole antenna.

Therefore, the antenna element can serve as an antenna for both the high frequency band FH and the low frequency band FL. Even though there is a restriction that the high frequency band FH should be twice the low frequency band FL, it can be satisfactorily used in a frequency band for a mobile phone.

Next, a fifth embodiment of the invention will be described with reference to FIGS. 16 to 19. Components similar to those in the above embodiments will be designated by the same reference numerals and repetitive explanations for those will be omitted.

In this embodiment, the ground-side end of an antenna element 42 is electrically connected to a ground conductor 16 via a parallel circuit 48 in which a first capacitor 44 and an inductor 46 are connected in a parallel manner and a second capacitor 50 in a serial manner. The electric length of the antenna element 42 is set to ¾ wavelength of the high frequency band FH, and ½ wavelength of the low frequency band FL. The parallel circuit 48 is configured so as to serve as a parallel resonant circuit in the high frequency band FH. The serial circuit of the inductor 46 of the parallel circuit 48 and the second capacitor 50 are configured so as to serve as a serial resonant circuit in the low frequency band FL. For example, the high frequency band is 1.5 GHz band for PDC, and the low frequency band is 800 MHz band for PDC. The value of the first capacitor 44 is 0.5 pF, the value of the inductor 46 is 18 nH, and the value of the second capacitor 50 is 1 pF.

As mentioned the above, the electric length of the antenna element 42 is set to ¾ wavelength of the high frequency band FH. Therefore, when the ground-side end of the antenna element 42 is made open, the antenna element serves as a pole antenna for the high frequency band FH, but does not serve as an antenna for and the low frequency band FL (see FIG. 17). On the other hand, when the ground-side end of the antenna element 42 is electrically connected to the ground conductor 16 via the parallel circuit 48 and the second capacitor 50 in a serial manner, the antenna element can satisfactorily serve as an antenna for both the high frequency band FH and the low frequency band FL (see FIGS. 18 and 19). In the high frequency band FH, the parallel circuit 48 serves as a parallel resonant circuit, the passage of the high frequency band FH is prevented and the ground-side end is made open so that the antenna element serves as a pole antenna for the low frequency band FL, the serial circuit of the inductor 46 and the second capacitor 50 serves as a serial resonant circuit, and the low frequency band FL passes through the antenna element to be electrically connected to the ground conductor 16, and thus the antenna element serves as a folded dipole antenna.

Therefore, the antenna element 42 can operate in both the high frequency band FH and the low frequency band FL. Even though there is a restriction that the high frequency band FH and the low frequency band FL have a prescribed relationship, it can be satisfactorily used in a frequency band for a mobile phone.

Figure 20:
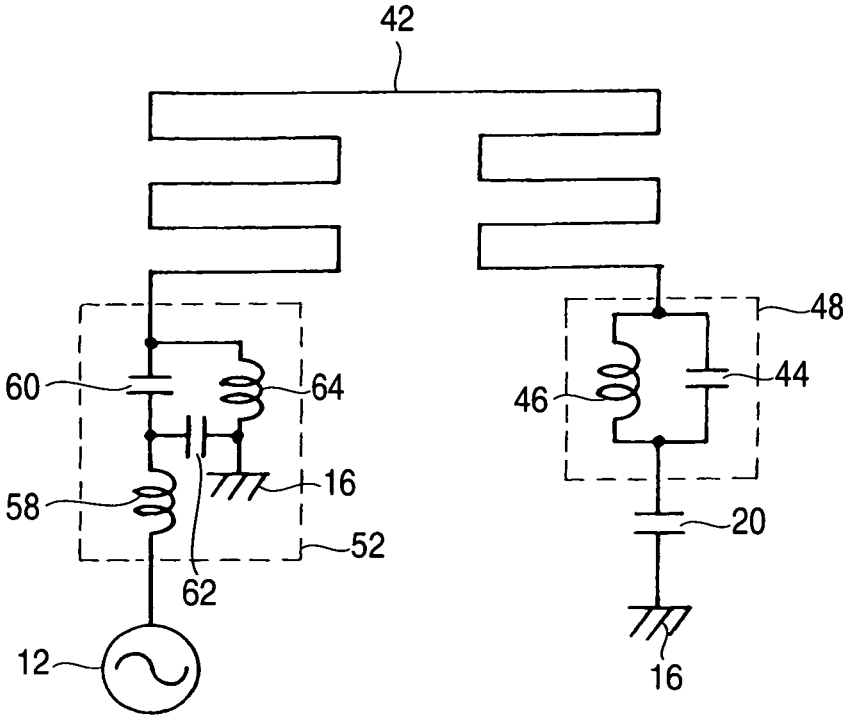
FIG. 20 is a circuit diagram illustrating a multi-band antenna according to a sixth embodiment of the invention.

Next, a sixth embodiment of the invention will be described with reference to FIGS. 20 to 22. Components similar to those in the above embodiments will be designated by the same reference numerals and repetitive explanations for those will be omitted.

In this embodiment, a power-side end of an antenna element 42 is electrically connected to a power feeding point 12 via a matching circuit 52 in a serial manner, The matching circuit 52 is, for example, configured such that a capacitor 60 and an inductor 58 are electrically connected in a serial manner between the power-side end of the antenna element 42 and the power feeding point 12, an inductor 64 is electrically connected between the power-side end of the antenna element 42 and a ground conductor 16, and the connection point of the capacitor 60 and the inductor 58 is electrically connected to the ground conductor 16 via the capacitor 62 in a serial manner. Accordingly, the antenna element 42 includes the matching circuit 52, and the electric length of the antenna element 42 is set to ¾ wavelength of the high frequency band FH, and ½ wavelength of the low frequency band FL. In the matching circuit 52, for example, the value of the capacitor 60 is 1 pF, the value of the inductor 58 is 4.7 nH, the value of the inductor 64 is 12 nH, and the value of the capacitor 62 is 1 pF.

Figure 21:
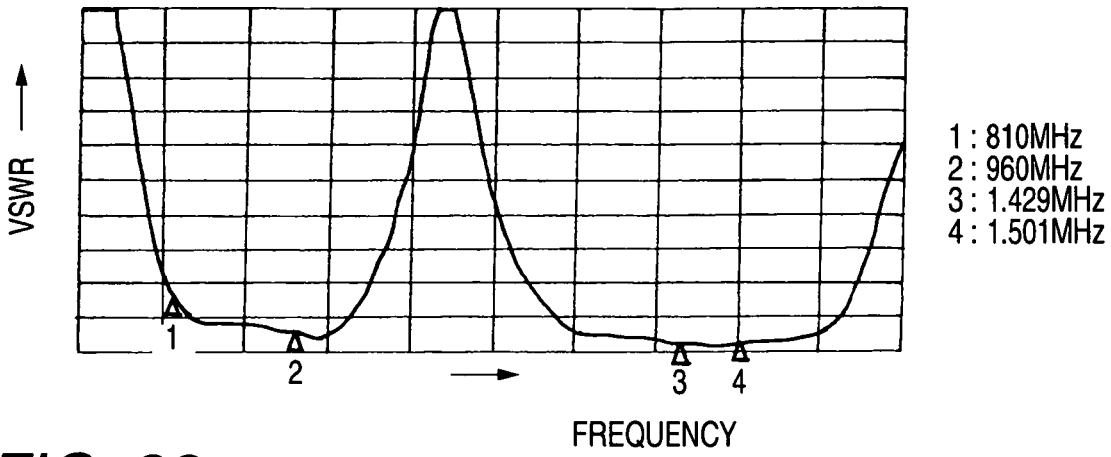
FIG. 21 is a VSWR characteristic graph of the multi-band antenna of FIG. 20.
Figure 22:
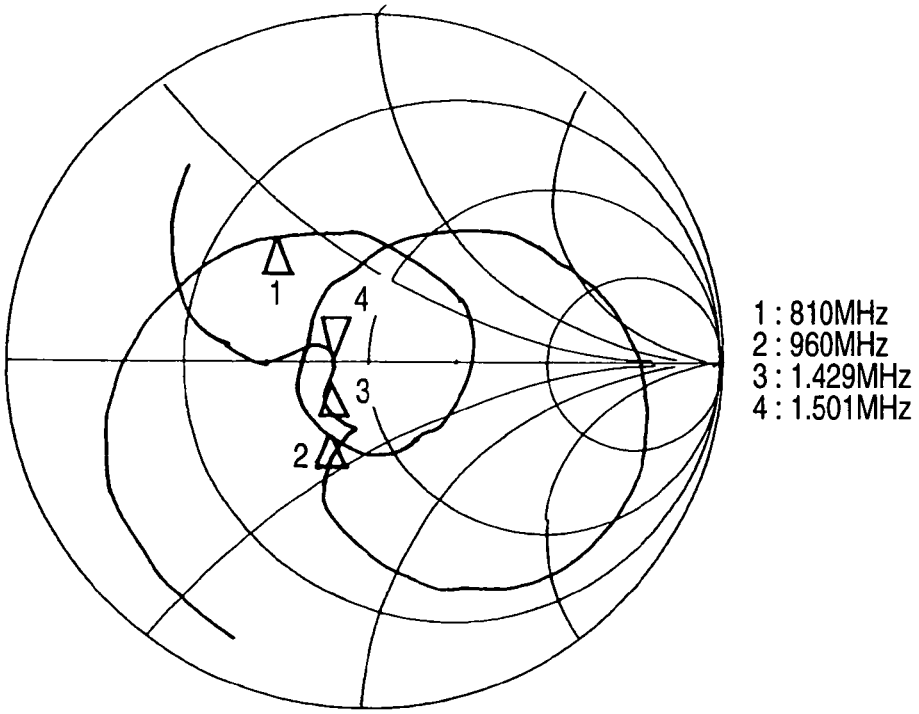
FIG. 22 is a Smith chart of the multi-band antenna of FIG. 20.

With the above configuration, it is possible to secure the sufficient property in a prescribed frequency band as shown in FIGS. 21 and 22 by providing the matching circuit 52. Further, it is possible to attain the impedance matching of the antenna element 42 and the power feeding point 12.

In the above embodiments, as the high frequency band FH, the middle frequency band FM, and the low frequency band FL, any appropriate frequency band suitable for mobile communication or data transmission can be selected. Further, in the first, second, fourth, and fifth embodiments, the matching circuit of the third and sixth embodiments may be inserted between the antenna element 10, 18, 32, 42 and the power feeding point 12 to reduce the influence of the anti-resonant point and to attain the impedance matching of the antenna element 10, 18, 32, 42 and the power feeding point 12. The electric length of the antenna element 10, 18, 32, 42 may be set so as to correspond to a frequency band having a certain width. However, it can be understood that the width is not necessarily set to a precise value.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Application No. 2005-375101 filed Dec. 27, 2005 including specification, drawings and claims is incorporated herein by reference in its entirety.

What is claimed is:

1. A multi-band antenna, adapted to operate in a first frequency band and a second frequency band which is lower than the first frequency band, the multi-band antenna comprising:

an antenna element comprising;

a first end, adapted to be electrically connected to a power feeding point; and a second end; and a circuit, electrically connected between the second end of the antenna element and a ground in a serial manner, wherein:

the antenna element is configured to serve as an antenna only in the first frequency when the second end is not electrically connected to the circuit, and the antenna element is configured to serve as an antenna in both the first and the second frequencies when the second end is electrically grounded through the circuit, wherein:

the antenna element has an electrical length of ¾ wavelength of the first frequency band; the circuit includes an inductor; and the inductor has such an inductance that an electrical length of the antenna element and the inductor corresponds to ½ wavelength of the second frequency band.

2. The multi-band antenna as set forth in claim 1, wherein: the first end of the antenna element is provided with a matching circuit.

3. A multi-band antenna, adapted to operate in a first frequency band and a second frequency band which is lower than the first frequency band, the multi-band antenna comprising:

an antenna element comprising;

a first end, adapted to be electrically connected to a power feeding point; and a second end; and a circuit, electrically connected between the second end of the antenna element and a ground in a serial manner, wherein:

the antenna element is configured to serve as an antenna only in the first frequency when the second end is not electrically connected to the circuit, and the antenna element is configured to serve as an antenna in both the first and the second frequencies when the second end is electrically grounded through the circuit, wherein:

the multi-band antenna is adapted to operate in a third frequency band which is lower than the second frequency band;

the antenna element has an electrical length of ¾ wavelength of the second frequency band;

the circuit includes an inductor and a capacitor which are electrically connected in a parallel manner;

the capacitor has such a capacitance that an electrical length of the antenna element and the capacitor corresponds to ½ wavelength of the first frequency band; and the inductor has such an inductance that an electrical length of the antenna element and the inductor corresponds to ½ wavelength of the third frequency band.

4. The multi-band antenna as set forth in claim 3, wherein: the first end of the antenna element is provided with a matching circuit.

5. A multi-band antenna, adapted to operate in a first frequency band and a second frequency band which is lower than the first frequency band, the multi-band antenna comprising:

an antenna element comprising;

a first end, adapted to be electrically connected to a power feeding point; and a second end; and a circuit, electrically connected between the second end of the antenna element and a ground in a serial manner, wherein:

the antenna element is configured to serve as an antenna only in the first frequency when the second end is not electrically connected to the circuit, and the antenna element is configured to serve as an antenna in both the first and the second frequencies when the second end is electrically grounded through the circuit, wherein:

the antenna element has an electrical length of ½ wavelength of the first frequency band and ¼ wavelength of the second frequency band;

the circuit includes a first inductor and a parallel circuit including a second inductor and a capacitor which are electrically connected in a parallel manner;

the parallel circuit is so configured as to parallel-resonate with the first frequency band; and the first inductor and the capacitor are so configured as to serial-resonate with the second frequency band.

6. The multi-band antenna as set forth in claim 5, wherein: the first end of the antenna element is provided with a matching circuit.

7. A multi-band antenna, adapted to operate in a first frequency band and a second frequency band which is lower than the first frequency band, the multi-band antenna comprising:

an antenna element comprising;

a first end, adapted to be electrically connected to a power feeding point; and a second end; and a circuit, electrically connected between the second end of the antenna element and a ground in a serial manner, wherein:

the antenna element is configured to serve as an antenna only in the first frequency when the second end is not electrically connected to the circuit, and the antenna element is configured to serve as an antenna in both the first and the second frequencies when the second end is electrically grounded through the circuit, wherein:

the antenna element has an electrical length of ¾ wavelength of the first frequency band and ½ wavelength of the second frequency band;

the circuit includes a first capacitor and a parallel circuit including an inductor and a second capacitor which are electrically connected in a parallel manner;

the parallel circuit is so configured as to parallel-resonate with the first frequency band; and the inductor and the second capacitor are so configured as to serial-resonate with the second frequency band.

8. The multi-band antenna as set forth in claim 7, wherein: the first end of the antenna element is provided with a matching circuit.

* * * * *